US006370326B2

(12) United States Patent
Cheng

(10) Patent No.: US 6,370,326 B2
(45) Date of Patent: Apr. 9, 2002

(54) SAFETY HOT AIR BLOWING GUN

(76) Inventor: Chuan-Hsin Cheng, 5F, No. 637-1, Sec. 5, Chung-Hsin Rd., San-Chung City, Taipei Hsien (TW)

( * ) Notice: Subject to any disclaimer, the term of this patent is extended or adjusted under 35 U.S.C. 154(b) by 0 days.

(21) Appl. No.: 09/798,840

(22) Filed: Mar. 1, 2001

(30) Foreign Application Priority Data

Jun. 1, 2000 (TW) ..... 089209385

(51) Int. Cl.[7] ..... F24H 3/00
(52) U.S. Cl. ..... 392/294; 392/379
(58) Field of Search ..... 392/384, 395, 392/379, 380, 383, 485, 488, 489, 473, 476

(56) References Cited

U.S. PATENT DOCUMENTS

| | | | | | |
|---|---|---|---|---|---|
| 994,259 | A | * | 6/1911 | Kazanjian | 392/384 |
| 1,771,366 | A | * | 7/1930 | Wyss et al. | 392/384 |
| 3,094,606 | A | * | 6/1963 | Ferris | 392/385 |
| 3,209,988 | A | * | 10/1965 | Fox et al. | 392/384 |
| 3,258,578 | A | * | 6/1966 | Ferris | 392/384 |
| 3,612,824 | A | * | 10/1971 | Berryman et al. | 392/383 |
| 3,668,370 | A | * | 6/1972 | Pattison | 392/385 |
| 5,909,535 | A | * | 6/1999 | Curwick et al. | 392/476 |

FOREIGN PATENT DOCUMENTS

| | | | |
|---|---|---|---|
| DE | 2432957 | * | 1/1976 |
| WO | 8302753 | * | 8/1983 |

* cited by examiner

*Primary Examiner*—John A. Jeffery
(74) *Attorney, Agent, or Firm*—Pro-Techtor International Services

(57) ABSTRACT

A hot air blowing gun includes a housing, an inner barrel mounted inside the housing and holding a high-impedance resistance type heating element around the inside wall thereof, a tapered, hollow, cylindrical nozzle fastened to the front side of the housing and spaced around the front side of the inner barrel, the nozzle having a slotted outward positioning flange fastened to the front side of the housing and spaced around the periphery of the inner barrel by a gap for ventilation, a fan motor assembly mounted inside the housing behind the inner barrel and controlled to blow air through the inner barrel and the nozzle, and a hollow, tapered protective cap fastened to the front side of the housing and suspended around the nozzle, the protective cap having an inside wall spaced from the periphery of the nozzle by a gap through which a part of the currents of air from the fan motor assembly passes to the outside of the hot air blowing gun via the protective cap to lower the temperature of the protective cap.

4 Claims, 3 Drawing Sheets

SAFETY HOT AIR BLOWING GUN

BACKGROUND OF THE INVENTION

The present invention relates to a hot air blowing gun and, more particularly, to a safety hot air blowing gun, which uses a protective cap to protect the user from contacting the hot nozzle during operation and, which defines a particular air passage around the nozzle for the passing of cold air to reduce the temperature of the protective cap.

FIG. 1 shows a hot air blowing gun according to the prior art. This structure of hot air blowing gun comprises a housing A, an inner barrel and nozzle assembly C mounted inside the housing A and partially projecting out of the front side of the housing A, a high-impedance resistance type heating element (not shown) wound round the inside wall of the inner barrel and nozzle assembly C, and a fan motor assembly B mounted inside the housing A behind the inner barrel and nozzle assembly C and controlled to blow currents of air through the inner barrel and nozzle assembly C to the outside of the hot air blowing gun for application. This structure of hot air blowing gun is functional, however it has drawbacks. Because the nozzle of the inner barrel and nozzle assembly C projects out of the front side of the housing A, the user may touch the hot nozzle of the inner barrel and nozzle assembly C by an accident during the operation of the hot air blowing gun.

During the operation of the hot air blowing gun, the temperature of the high-impedance resistance type heating element is as high as 500~600° C. and the nozzle of the inner barrel and nozzle assembly C is continuously heated by hot air passing through. When touching the hot nozzle of the inner barrel and nozzle assembly C by an accident, the hand will be severely scalded with the hot nozzle. Further, the inner barrel and nozzle assembly C has a metal locating -ring D disposed around the periphery and fastened to the inside wall of the housing A. Because the locating ring D is fastened to the inside wall of the housing A, it prohibits cold air from passing through the gap between the outside wall of the inner barrel and nozzle assembly C and the inside wall of the housing A to reduce the temperature of the body of the nozzle of the inner barrel and nozzle assembly C. After a certain length of time in operation, the temperature of the nozzle of the inner barrel and nozzle assembly C may become higher than the melting point of certain materials, for example, wood, plastics, paper, and etc. When touching materials of low melting point with the hot nozzle of the inner barrel and nozzle assembly C, the materials may be burned, causing a disaster.

SUMMARY OF THE INVENTION

The present invention has been accomplished to provide a hot air blowing gun, which eliminates the aforesaid drawbacks. It is the main object of the present invention to provide a hot air blowing gun, which is safe in use. According to one aspect of the present invention, the hot air blowing gun comprises a housing, an inner barrel mounted inside the housing and holding a high-impedance resistance type heating element around the inside wall thereof, a tapered, hollow, cylindrical nozzle fastened to the front side of the housing and spaced around the front side of the inner barrel, the nozzle having a slotted outward positioning flange fastened to the front side of the housing and spaced around the periphery of the inner barrel by a gap for ventilation, a fan motor assembly mounted inside the housing behind the inner barrel and controlled to blow air through the inner barrel and the nozzle, and a hollow, tapered protective cap fastened to the front side of the housing and suspended around the nozzle to prohibit the user from touching the nozzle. According to another aspect of the present invention, the protective cap is suspended around the periphery of the inner barrel, having a slotted, outwardly extended locating flange fastened to the inside wall of the housing. During operation hot air passes through the inner diameter of the inner barrel and the inner diameter of the nozzle to the outside of the hot air blowing gun for application, and cold air passes through the gap between the outside wall of the nozzle and the inside wall of the housing to reduce the temperature of the outside wall of the nozzle. According to still another aspect of the present invention, a gap is defined between the inside wall of the protective cap and the outside wall of the nozzle for the passing of cold air to minimize transferring of heat from the nozzle to the protective cap.

DETAILED DESCRIPTION OF THE PREFERRED EMBODIMENT

Figure 1:
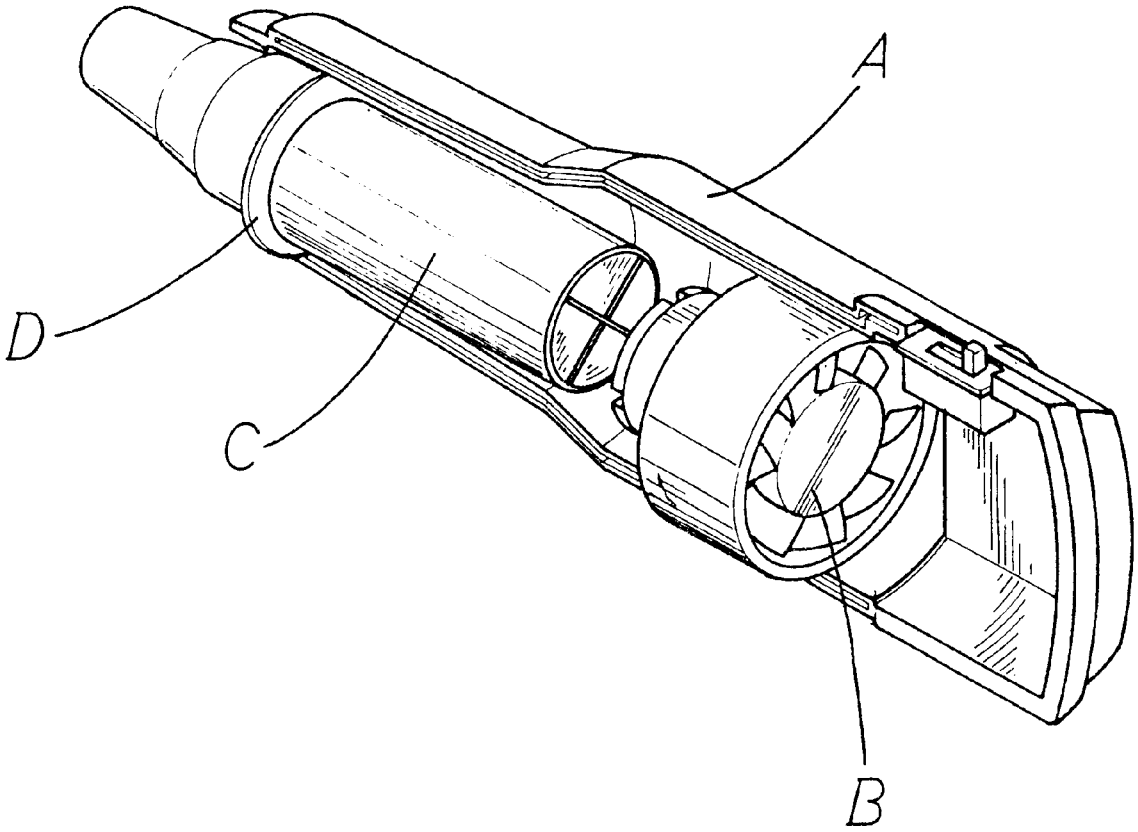
FIG. 1 PRIOR ART
FIG. 1 is a cutaway view of a hot air blowing gun according to the prior art.
Figure 2:
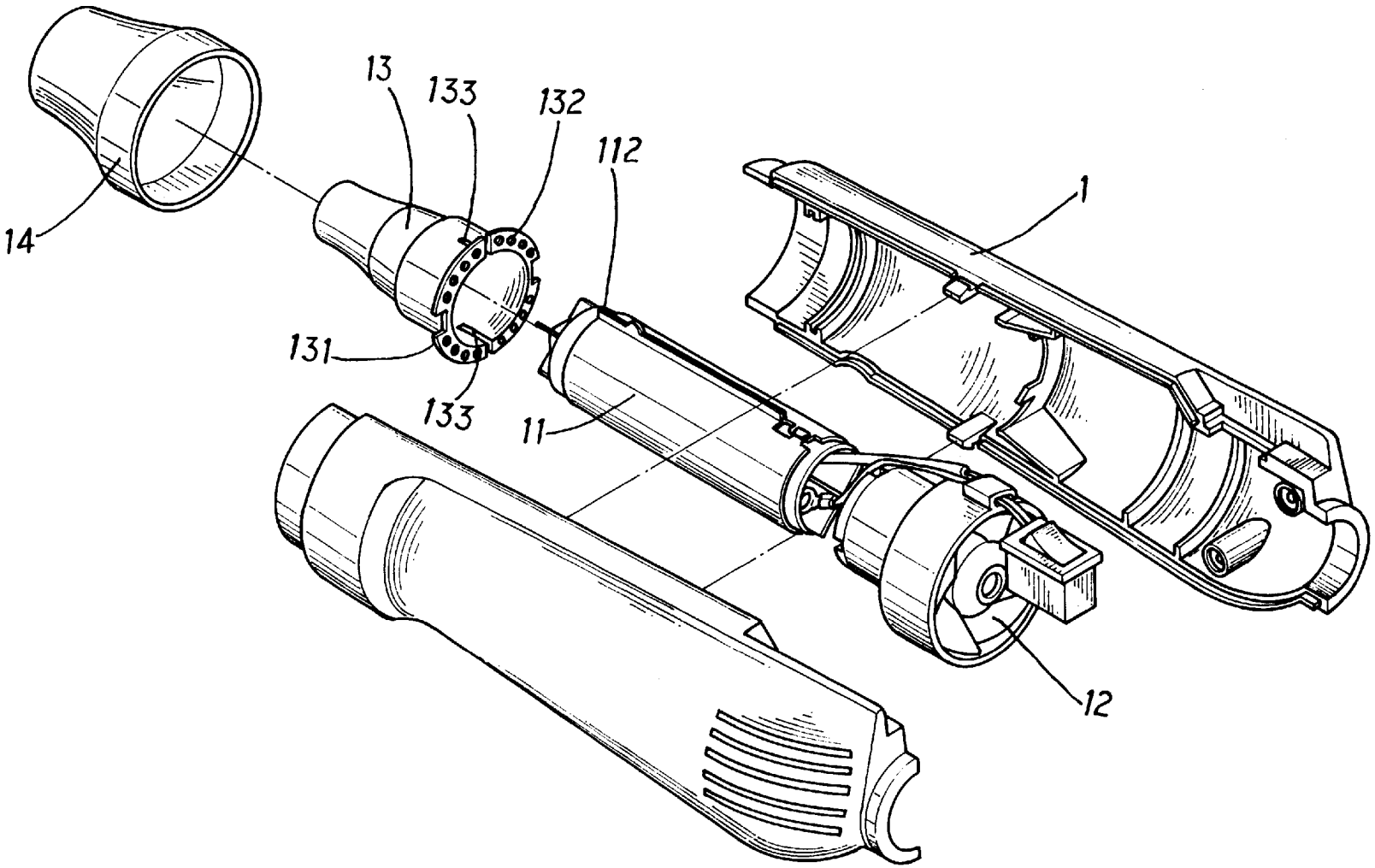
FIG. 2 is an exploded view of a hot air blowing gun according to the present invention.
Figure 3:
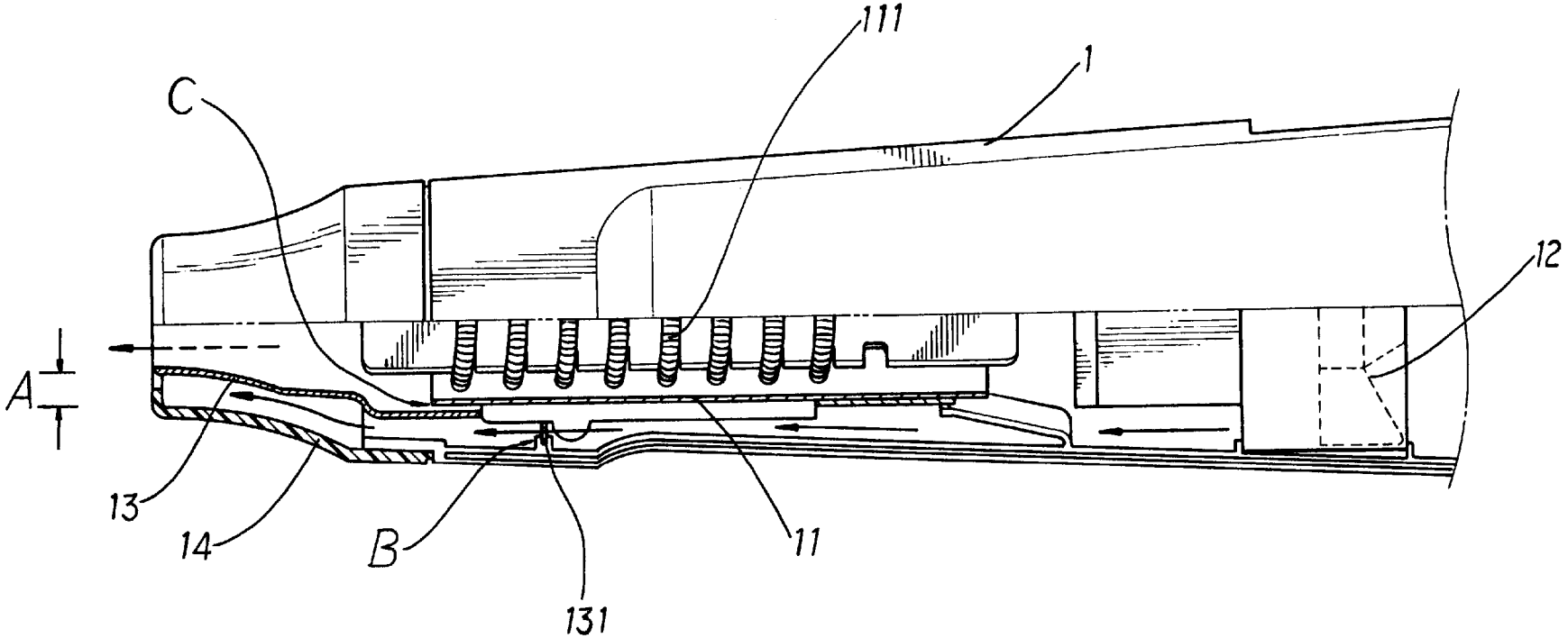
FIG. 3 is a plain view of the present invention, showing air passages through the inside of the inner barrel and the nozzle and the outside of the inner barrel and the nozzle.

Referring to FIGS. 2 and 3, a hot air blowing gun is shown comprising a cylindrical housing 1, an inner barrel 11 mounted inside the housing 1, a high-impedance resistance type heating element 111 wound round the inside wall of the inner barrel 11, a nozzle 13 fastened to the front end of the inner barrel 11, a fan motor assembly 12 mounted inside the housing 1 and disposed at the rear side of the inner barrel Hand controlled to blow air through the inner barrel 11 toward the nozzle 13, and a protective cap 14 fastened to the front end of the housing 1 and covered around the nozzle 13. The nozzle 13 is a tapered, hollow, cylindrical member comprising an outward positioning flange 131 for positioning inside the front end of the housing 1 to keep the periphery of the nozzle 13 away from the inside wall of the housing 1 at a distance A. The outward positioning flange 131 has a plurality of radially arranged through holes 132. The protective cap 14 is a hollow, tapered, transparent member preferably made of heat-resisting plastics. After installation of the protective cap 14 in the housing 1, the front side of the protective cap 14 protrudes forwards over the front side of the nozzle 13 to prohibit accidental contact of the user's hand with the nozzle 13, and a gap B is left between the inside wall of the protective cap 14 and the outside wall of the nozzle 13.

Referring to FIG. 3 again, when in use, the fan motor assembly 12 is started to blow air through the inner barrel 11 and the nozzle 13 to the outside of the hot air blowing gun. When passing through the inner barrel 11, the high-impedance resistance type heating element 111 heats currents of air, therefore an outward flow of hot air is provided for application. At the same time, a part of the currents of air from the fan motor assembly 12 is blown through the through holes 132 of the outward positioning flange 131 to reduce the temperature at the area between the outward positioning flange 131 and the housing 1. The currents of air which pass through the through holes 132 of the outward positioning flange 131 flow forwards through the gap B between the inside wall of the protective cap 14 and the outside wall of the nozzle 13 to the outside of the hot air blowing gun to reduce the temperature of the protective cap 14, preventing the protective cap 14 from deformation due to heat.

Referring to FIGS. 2 and 3 again, as indicated above, the contact area between the nozzle 13 and the inner barrel 11 is minimized to reduce heat transfer rate. The nozzle 13 has an outer diameter gradually reduced forwards. The inner diameter of the rear end of the nozzle 13 is greater than the outer diameter of the ninner barrel 11. Further, the nozzle 13 has a plurality of longitudinal slots 133 extended to the rear end thereof. The inner barrel 11 comprises a plurality of longitudinal locating ribs 112 spaced around the periphery and respectively engaged into the longitudinal slots 133 of the nozzle 13. After connection of the locating ribs 112 of the inner barrel 11 to the longitudinal slots 133 of the nozzle 13, a gap C is left between the periphery of the inner barrel 11 and the inside wall of the nozzle 13. Because the contact area between the inner barrel 11 and the nozzle 13 is limited to particular points (the areas between the ribs 112 and the slots 133) and because a gap C is left between the periphery of the inner barrel 11 and the inside wall of the nozzle 13, less heat is transmitted from the inner barrel 11 to the body of the nozzle 13. Therefore, the hot air blowing gun of the present invention is safe in use.

A prototype of hot air blowing gun has been constructed with the features of FIGS. 2 and 3. The hot air blowing gun functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A hot air blowing gun of the type comprising a cylindrical housing having a front side and a rear side, an inner barrel mounted inside said housing, said inner barrel having a front side and a rear side, a high-impedance resistance type heating element mounted around an inside wall of said inner barrel, a nozzle fastened to the front side of said housing, said nozzle having a front side and a rear side, and a fan motor assembly mounted inside said housing and aimed at the rear side of said inner barrel and controlled to blow air through said inner barrel and said nozzle, wherein said nozzle is a tapered, hollow, cylindrical member comprising an outward positioning flange disposed around the rear side thereof and a plurality of longitudinal slots extended to the rear side thereof, said outward positioning flange being positioned inside the front side of said housing to keep the periphery of said nozzle away from an inside wall of the housing at a distance for the passing of currents of air from said fan motor assembly, said outward positioning flange having a plurality of radially arranged through holes for the passing of currents of air from said fan motor assembly; a hollow, tapered protective cap is fastened to the front side of said housing and suspended around said nozzle, said protective cap having an inside wall spaced from the periphery of said nozzle by a gap through which a part of the currents of air from said fan motor assembly passes to the outside of the hot air blowing gun via said protective cap; said inner barrel comprises a plurality of longitudinal ribs spaced around the periphery of the front side thereof and respectively coupled to the longitudinal slots of said nozzle.

2. The hot air blowing gun of claim 1 wherein the rear side of said nozzle has an inner diameter greater than the outer diameter of said inner tube so that a gap is defined between an inside wall of said nozzle and the periphery of said inner barrel for the passing of a part of the currents of air from said fan motor pass to the outside of the hot air blowing gun via said protective cap.

3. The hot air blowing gun of claim 1 wherein said protective cap is molded from transparent, heat-resisting plastics.

4. The hot air blowing gun of claim 1 wherein said protective cap has a front side protruded forwardly over the front side of said nozzle.

* * * * *